United States Patent [19]

Bolze et al.

[11] Patent Number: 4,999,859

[45] Date of Patent: Mar. 19, 1991

[54] W.C. TOILETS WITH LOW CONSUMPTION OF RINSING WATER

[75] Inventors: Bernard Bolze, Blere; Daniel Pittet, Tours, both of France

[73] Assignee: Sanitaire Equipment, Tours, France

[21] Appl. No.: 440,115

[22] Filed: Nov. 22, 1989

Related U.S. Application Data

[63] Continuation-in-part of Ser. No. 223,622, Jul. 25, 1988, abandoned.

[30] Foreign Application Priority Data

Jul. 31, 1987 [FR] France ..... 87 10935

[51] Int. Cl.[5] ..... E04D 3/10

[52] U.S. Cl. ..... 4/362; 4/300; 4/321; 4/367

[58] Field of Search ..... 4/300, 233, 319–324, 4/328, 329, 332, 334, 353, 354, 359–362, 366, 367, 415, 434

[56] References Cited

U.S. PATENT DOCUMENTS

| | | | |
|---|---|---|---|
| 1,200,080 | 11/1916 | Clarke | 4/321 |
| 1,996,325 | 4/1935 | Cox | 4/320 X |
| 3,514,231 | 5/1970 | Belden | 4/354 X |
| 3,540,590 | 11/1970 | Schneider et al. | 4/320 X |
| 3,996,628 | 12/1976 | Mollerstedt | 4/361 |
| 4,052,758 | 10/1977 | Arena | 4/320 |
| 4.156,297 | 5/1979 | Pilolla | 4/320 |
| 4,170,048 | 10/1979 | Anthony | 4/321 |
| 4,232,409 | 11/1980 | Van Pham | 4/362 |
| 4,561,132 | 12/1985 | Lew et al. | 4/321 X |

FOREIGN PATENT DOCUMENTS

| | | | |
|---|---|---|---|
| 2902476 | 7/1979 | Fed. Rep. of Germany | 4/321 |
| 3605446 | 8/1987 | Fed. Rep. of Germany | 4/321 |
| 1381628 | 1/1975 | United Kingdom | 4/319 |

*Primary Examiner*—Henry J. Recla
*Assistant Examiner*—Casey Jacyna
*Attorney, Agent, or Firm*—Fisher, Christen & Sabol

[57] ABSTRACT

This invention relates to a toilet system of the type with direct evacuation and rinsing without flushing effect nor siphon, constituted by a bowl of generally truncated form comprising at the level of its small base, in lower position, a trap controlled by a pneumatic jack, for intermittent communication with an evacuation conduit, and the bowl comprises at least one nozzle for projecting rinsing and evacuation water coming from a pressurizing chamber, characterized in that said system is connected to a source of energy constituted by a source of compressed air communicating on the one hand with the pressurizing chamber to ensure high pressure supply of the rinsing and evacuation nozzles and, on the other hand, with the pneumatic jack for maneuvering the trap, such communication being ensured by a pneumatic slide valve adapted to regulate and control the evacuation cycle comprising the synchronized phases, firstly, of opening of the trap and of projection of pressurized water and, secondly of closure of the trap and stop of the projection of water.

6 Claims, 2 Drawing Sheets

W.C. TOILETS WITH LOW CONSUMPTION OF RINSING WATER

This is a continuation-in-part of our prior U.S. patent application, Ser. No. 223,622, filed July 25, 1988, now abandoned.

FIELD OF THE INVENTION

The present invention relates to a toilet system of the type with direct evacuation and rinsing without an effect of flushing nor siphon.

The invention aims at providing a W.C. installation which avoids the drawbacks of the conventional systems operating by the flushing effect, which require a considerable quantity of water each time they are used.

In particular, the invention aims at providing toilet systems under conditions and circumstances where it is not possible to have a large reserve of water available, for example and in particular in road or railway vehicles, and in mobile dwellings (caravans, mobile homes, habitable watercraft, etc . . . ).

BACKGROUND OF THE INVENTION

Applicants' co-pending patent application Ser. No. 223,622 discloses a W.C. system of the type specified, which aims at avoiding and overcoming the drawbacks of the conventional systems: high consumption of clear water and necessity of connection to a sewage disposal system (in toilets with flushing effect) or manipulation of toxic agents, efficiency limited in time, unpleasant residual odours, necessity to store the treated effluents (in chemical toilets).

In the known device as described in the patent application mentioned above, an evacuation by a metered and limited quantity of water under high pressure has been provided.

It is an object of the present invention to develop the possibilities of toilet systems with direct evacuation and rinsing under pressure, particularly in the case of systems installed in road or railway vehicles generally having a supply of oiled compressed air of 6 to 8 bars available.

The installation according to the invention makes it possible to benefit from the advantages of rinsing under pressure, whereby the installation is cleaned between two uses, employing a limited quantity of water, of the order of 25 cl.

A system is therefore produced, operating entirely automatically, the cycle of evacuation and of rinsing being triggered off simply by the user pressing a button, without the use of electrical energy.

The system of the invention uses exclusively, both as source of power energy and as source of regulation energy, the compressed air drawn from the general equipment of the vehicle which makes it possible to control the whole cycle without consuming electricity, consequently under totally safe conditions and in perfectly reliable manner.

SUMMARY OF THE INVENTION

To that end, the invention relates to a toilet system of the type with direct evacuation and rinsing without flushing effect nor siphon, the toilet being constituted by a bowl of generally truncated form comprising at the level of its small base, in lower position, a trap controlled by a pneumatic jack, for intermittent communication with an evacuation conduit, and the bowl further comprises at least one nozzle for projecting rinsing and evacuation water coming from a pressurizing chamber, said system being characterized in that it is connected to a source of energy constituted by a source of compressed air communicating on the one hand with the pressurizing chamber to ensure high pressure supply of the rinsing and evacuation nozzles and, on the other hand, with the pneumatic jack for manoeuvring the trap, such communication being ensured by a pneumatic slide valve adapted to regulate and control the evacuation cycle comprising the synchronized phases, firstly, of opening of the trap and of projection of pressurized water and, secondly, of closure of the trap and stop of the projection of water.

Furthermore, according to the invention, when the system is in the position of rest, the slide valve is adapted to maintain the trap in closed position and to ensure inactivation of the pressurizing chamber, the latter being isolated from the source of compressed air.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
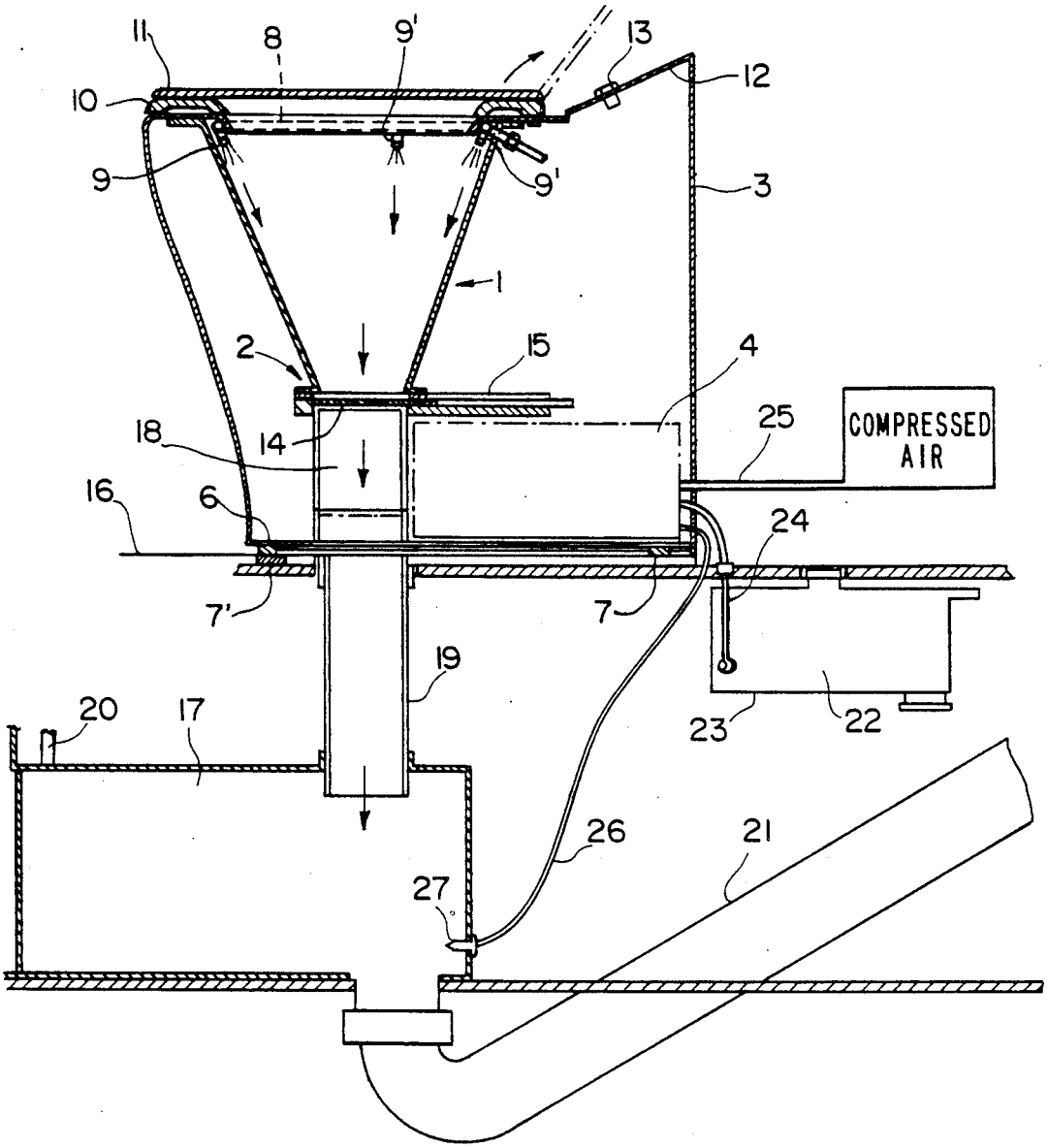
FIG. 1 is a view in longitudinal section of the bowl of the toilet system according to the invention.

Referring now to the drawings, FIG. 1 shows the toilet system according to the invention which is essentially constituted by a bowl 1, of generally truncated shape, resting on its small base 2.

This bowl is advantageously made of white glass-fiber reinforced polyester.

The bowl is itself built in a stand forming housing 3 which encompasses the bowl as well as the control assembly 4 (illustrated in detail in FIG. 2) and mounted on rails 5 resting on the base 6 of the housing.

The base 6 may advantageously rest on the floor of the premises via shock mounts, or silentblocs, 7, 7' to avoid transmission of vibrations.

In its upper part, the bowl comprises an inwardly oriented rim 8 advantageously constituted by the extension of the upper horizontal face of the housing 3 comprising, to that end, a substantially elliptical gap and corresponding to the large base of the truncated bowl 1.

Beneath this rim 8 are housed spray nozzles, four in number and of which three are shown in the drawings under references 9, 9', 9''.

The periphery of the bowl accommodates, in known manner, a two-piece toilet seat constituted by the seat 10 proper and the lid 11.

On the rear part of the upper face of the housing, to the rear of the bowl, there is provided for example an inclined plane 12 accommodating the button 13 of the contactor 47 for controlling the evacuation and rinsing cycle under the conditions which will be described hereinafter.

The base 2 of the bowl comprises a closure trap 14 of the gate valve type, manoeuvred in a substantially horizontal plane by a pneumatic jack 15.

Below the trap, the installation comprises a vertical conduit constituting the start of evacuation and collection of the effluents, terminating in a storage tank 17 which may be disposed inside the housing 3 and which, in the present embodiment, is located below the floor 16 of the installation, this tank 17 being connected to the lower evacuation conduit 18 by the communication pipe 19.

The storage tank 17 itself comprises, in its lower part, an outlet formed by a flexible hose 21 for intermittently evacuating the stored effluents between two periods of emptying.

A vent for ventilation is provided at 20.

Figure 2:
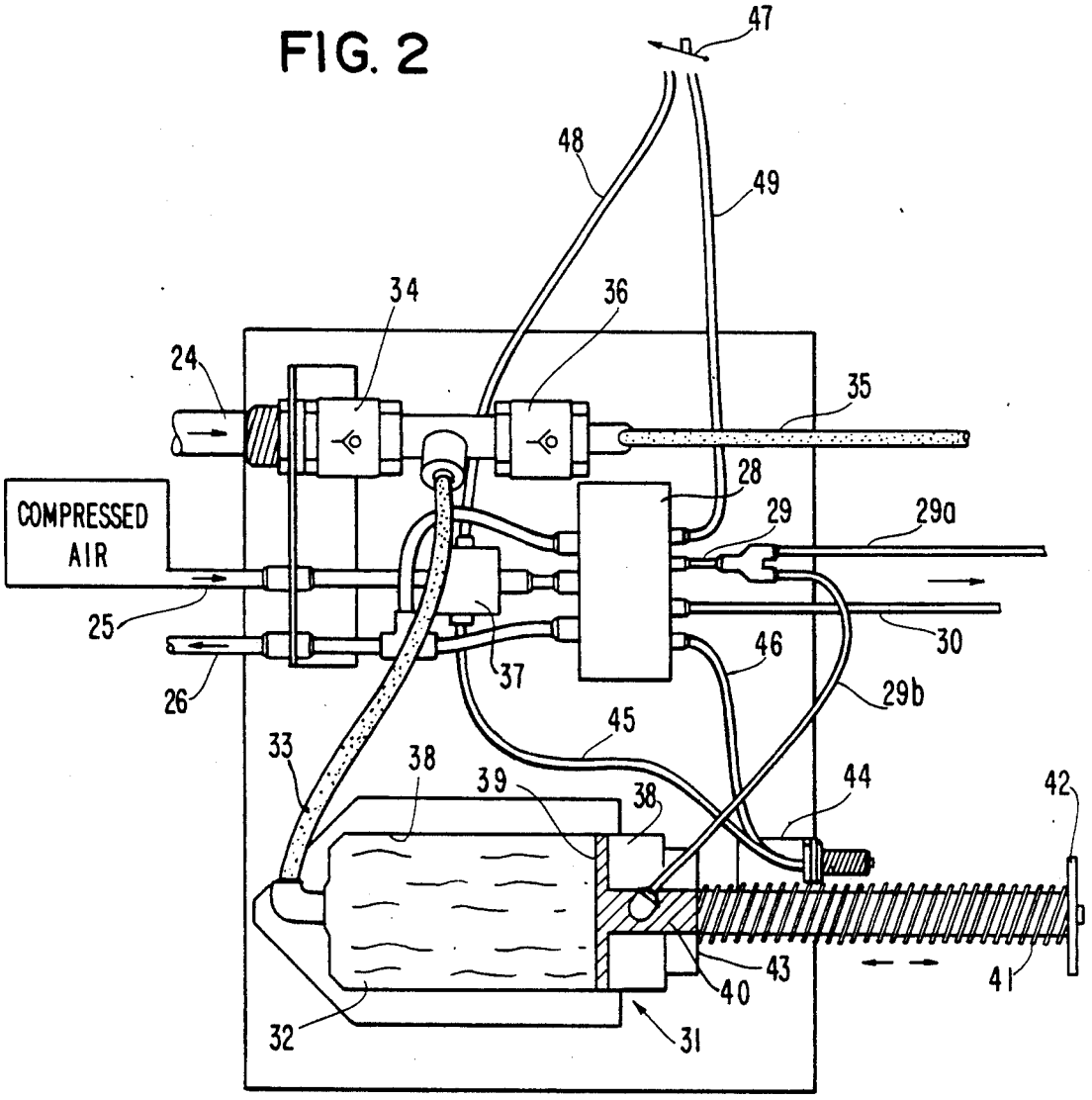
FIG. 2 shows a diagram of the pneumatic circuits for controlling the evacuation cycle.

The installation is itself connected to a tank of clear water 22 comprising a strainer basket 23 at the end of the immersion tube 24 and supplying the regulation unit shown in FIG. 2.

Finally, the assembly is supplied with energy in the form of compressed air from the conduit 25 terminating in the regulation and control unit of FIG. 2 and connected to a source of oiled compressed air at 6 to 8 bars, available on the vehicle.

It will be readily appreciated that the installation may operate, with complete reliability, mechanically without using electrical energy, therefore without the risks associated with the presence of electrical conduits and circuits in a wet medium.

Operation of the pneumatic control unit is illustrated in FIG. 2.

This unit, preferably mounted on a platform sliding on rails, so as to allow easy maintenance thereof, is supplied with compressed air at 6 to 8 bars via conduit 25 described hereinabove and with clear water via conduit 24.

A conduit 26 serves for evacuation of the returning compressed air and it terminates at the base of the storage tank 17 where it opens out via nozzle 27, allowing the homogeneous distribution of the effluents within the tank, by turbulence.

The compressed air from supply conduit 25 arrives at the slide valve 28 which allows intermittent distribution of the motive compressed air towards the manoeuvring members.

The slide valve comprises two alternate compressed air outlets, namely a first outlet 29 and a second outlet 30.

The second outlet 30 terminates at a second inlet (not shown) of the double-acting jack 15 for pneumatically controlling the trap 14.

This double-acting jack, when it is supplied via its second inlet via pipe 30, ensures return of the trap and maintains it in its position of closure.

Alternately, when conduit 30 is not under pressure, the slide valve is adapted to send the compressed air under pressure in conduit 29 which itself terminates at the two sub-conduits **29*a* and 29*b*** thus supplied simultaneously.

Whereas the supply of conduit 30, ensuring closure of the trap, corresponds to the position of rest of the slide valve, the installation being in inactive position, supply of conduit 29 corresponds to the initiation of the cycle of evacuation and rinsing.

To that end, conduit **29*a*, terminating at the first inlet of the double-acting jack 15, ensures retraction of the trap 14** and consequently the opening of the base of the bowl in order to evacuate the effluents.

At the same time, conduit **29*b* terminates at the pressurizing chamber 31 and ensures evacuation under high pressure of the dose of water 32** contained in this chamber.

To that end, chamber 31 is supplied with clear water via conduit 33 which allows both the reception of the water from conduit 24 in the suction phase, through the non-return valve 34, whilst the same conduit 33 allows evacuation of the pressurized water towards conduit 35 terminating at the spray nozzles 9, 9′, 9″, with the interposition of the non-return valve 36.

To control the phases of suction and of delivery, chamber 31 comprises a piston 39 dividing the chamber into two volumes, namely a volume 38 disposed on the rear face of the piston and communicating precisely with the admission of compressed air **29*b*, whilst volume 38′, corresponding to the front face of the piston 39, constitutes the reserve of water 32**.

Piston 39 is fast with a rod 40 projecting outside the chamber and comprising a helical spring 41 mounted on the periphery and coaxially to said rod; spring 41 being compressed between the rear stop 42 fast with the terminal end of rod 40 and the front stop 43 constituted by the corresponding wall of chamber 31.

Cooperating with stop 42 is an end-of-stroke contactor 44 connected on the one hand via pneumatic conduit 45 to the source of compressed air supply 25 and on the other hand via pneumatic conduit 46, to the slide valve.

The thrust exerted by the stop 42 on the contactor 44 allows communication of the outlet conduit 46 with the inlet conduit 45, consequently sending to the slide valve a pneumatic impulse corresponding to the end-of-stroke positioning of the stop 42 and therefore of the piston 39 inside the chamber 31.

Finally, the slide valve is connected to a manual contactor 47 for controlling the beginning of cycle, this contactor being controlled by the user pressing on button 13.

This contactor is connected by a pneumatic inlet conduit 48 to the source of compressed air; this supply is obtained by the distributor 37 supplying, from conduit 25, on the one hand, the slide valve and, on the other hand, the contactor 44 via conduit 45 and, finally, the manual contactor 47 via conduit 48.

The manual contactor 47 is in turn connected to the slide valve by the pneumatic outlet conduit 49.

The pressure exerted on button 13 ensures communication of the inlet conduit 48 with the outlet conduit 49, whilst they are normally isolated when the installation is in position of rest; this communication results in an initial pneumatic impulse sent to the slide valve which controls the beginning of the cycle of evacuation and of rinsing.

Functioning of the installation follows readily from the foregoing description.

Under the action of the manual contactor for rinsing, an initial impulse is sent to the slide valve which displaces the slide and transmits the compressed air pressure through conduit 29 on the one hand towards the second inlet of the double-acting jack of the trap, ensuring opening thereof, via the conduit **29*a*; and at the same time, conduit 29*b* transmits the pneumatic pressure in the volume 38, thus ensuring displacement of the piston 39 which delivers the water 32 through the conduits 33, the non-return valve 36 and the conduit 35 towards the rinsing nozzles 9, 9′, 9″**.

In this way, at the beginning of the operational cycle after the bowl has been used, the user triggers off, by a simple manoeuvre and without requiring electrical energy, on the one hand the opening of the trap and at the same time the projection of water under high pressure over the walls of the bowl.

The high pressure of the water enables an immediate effect of evacuation and of rinsing to be obtained, using a limited quantity of water which may be no more than 25 cl.

During the whole of this evacaution phase, the double-acting jack 15 maintains the trap in open position.

The cycle of opening and of evacuation is limited to a period of some seconds, for example 5 to 6 seconds.

Control of end of cycle is automatically ensured when all the reserve of water 32 has been evacuated under pressure towards the nozzles; this end of cycle is detected by the contactor 44 on which bears the stop 42, corresponding in that case to the positioning of the piston 39 at the end of stroke when substantially all the water has been evacuated.

The contactor ensuring communication of inlet conduit 45 and outlet conduit 46 allows transmission of a pneumatic impulse towards the slide valve 28 which returns the slide towards its initial position, that is to say that the pneumatic flux is cut both at the level of conduit 29*a* and at the level of conduit 29*b* (chamber 31 is no longer supplied with compressed air).

On the contrary, conduit 30 then receives the pneumatic flux which is transferred to the first inlet of the double-acting jack 15, thus ensuring the return of the trap towards its position of closure and maintaining this trap in closed position.

Piston 39 is displaced under the pneumatic pressure developed in volume 38, against the action of spring 41; when volume 38 is no longer supplied with compressed air, the force of the return spring becomes prevalent and drives piston 39 rearwardly, returning to its initial position; in this movement, the piston provokes drawing and suction of the quantity of water 32, since, in this phase, the non-return valve 36 is in closed position whilst the non-return valve 34 is in open position; in this way, the piston is automatically returned and a perfectly metered quantity of rinsing water is drawn and stored in the pressurizing chamber 31 for future use.

According to an advantageous embodiment, the slide of the slide valve is provided so that it provokes, under the action of the contactor 44, firstly, the return of the trap into its closed position, whilst the interruption of the supply of pressurized water is delayed by some fractions of a second; in this way, at the end of cycle, the trap is closed whilst a minimum quantity of water continues to be sprayed from the nozzles, this ensuring a film of water on the wall of the trap; in this way, a perfect seal of the bowl with respect to odours is obtained, on the one hand, whilst a film of water contributes to the cleanliness of the bottom of the bowl, by avoiding the formation of deposits.

According to a variant embodiment (not shown), the pneumatic control and regulation unit is assembled in a cabinet offset with respect to the appliance and to the bowl unit; the cabinet may be disposed outside and in the immediate proximity of the bowl unit and, in this way, the base of the bowl unit is cleared in order possibly to house therein the tank of effluents which is in that case integrated in the appliance.

What is claimed is:

1. A toilet system comprising:

(a) a bowl of generally truncated form;

(b) a trap disposed near the lower end of, and operably associated with, said bowl;

(c) an evacuation conduit located beneath said trap;

(d) a pneumatic jack for controlling the movement of said trap, whereby said bowl may intermittently be placed in communication with said evacuation conduit;

(e) a pressurized chamber for dispensing rinsing and evacuation water;

(f) at least one nozzle operably associated with said bowl for projecting said rinsing and evacuation water into said bowl, said rinsing and evacuation water coming to said at least one nozzle from said pressurized chamber;

(g) a source of compressed air for energizing said system;

(h) a pneumatic slide valve, operably connected to said pneumatic jack and to said pressurized chamber, for controlling said source of compressed air and for regulating the operational cycle of said system;

(i) a first contactor, constituted by a manual contactor, which is disposed in a position accessible to the user of said system, said manual contactor being operably connected to said slide valve for controlling said slide valve;

wherein, when said manual contactor is energized, said slide valve is activated to, firstly, allow compressed air to be applied to said pneumatic jack and to said pressurized chamber to open said trap to project water through said at least one nozzle and, secondly, to isolate said pneumatic jack and said pressurized chamber from said source of compressed air to close said trap and ensure inactivation of said pressurized chamber and thus define a position of rest for said system.

2. The toilet system of claim 1 wherein said manual contactor is operably connected to two pneumatic conduits, the first of said pneumatic conduits being operably connected to said slide valve, the second of said pneumatic conduits being operably connected to said source of compressed air, said two pneumatic conduits being functionally isolated from each other when said manual contactor is not depressed, but said manual contactor being adapted, when depressed by the user of said system, to place said two pneumatic conduits in functional communication, thereby sending a pneumatic impulse to said slide valve, displacing said slide valve and initiating said evacuation cycle of said system, whereby said source of compressed air is placed in functional communication with said chamber for pressurizing the water, and whereby said source of compressed air is placed in functional communication with said pneumatic jack, thus moving said trap into the open position.

3. The toilet system of claim 1 wherein said slide valve includes a control member, said control member being adapted, at the end of said evacuation cycle, to isolate said source of compressed air from said pressurizing chamber, said control member also being adapted to ensure communication of said source of pressurized air with said pneumatic jack, whereby said trap is returned to, and maintained in, a closed position.

4. The toilet system of claim 3 wherein said control member is operably associated with said pressurizing chamber and includes means for detecting when all of the water within said chamber has been evacuated, said control member being connected to two pneumatic conduits, the first of said two pneumatic conduits being operably connected to said source of compressed air, the second of said two pneumatic conduits being operably connected to said slide valve, said two pneumatic conduits being functionally isolated from each other while said pressurizing chamber is at least partially filled with water, said two pneumatic conduits being adapted, however, when said pressurizing chamber becomes substantially empty of water, to functionally communicate with each other and convey a pneumatic impulse to return said slide towards its position of rest, thereby isolating said pressurizing chamber with respect to said source of compressed air and ensuring the functional communication of said source of compressed air with said pneumatic jack, returning said trap to, and maintaining said trap in, a closed position.

5. The toilet system of claim 1 wherein said slide valve is adapted to stop the expulsion of water from said pressurizing chamber slightly after said trap is closed, whereby a limited quantity of water continues to be poured from said at least one spray nozzle after closure of said trap, ensuring the maintenance of a film of water over the bottom of said bowl after said bowl has been sealed, wherein said pressurizing chamber comprises a cylinder containing a piston, said piston dividing said pressurizing chamber into two volumes, a dry volume disposed at the rear of said piston, and a volume receiving said water disposed in front of said piston, said dry volume being operably connected by said slide valve with said source of compressed air for ensuring the displacement of said piston against the action of a return member, said volume receiving water being operably connected with said source of water and said spray nozzles, whereby the displacement of said piston by said compressed air pressurizes said water within said volume receiving water, and whereby the action of said return member causes said piston to move back, refilling said pressurizing chamber.

6. The toilet system of claim 1 wherein said slide valve is adapted to stop the expulsion of water from said pressurizing chamber slightly after said trap is closed, whereby a limited quantity of water continues to be poured from said at least one spray nozzle after closure of said trap, ensuring the maintenance of a film of water over the bottom of said bowl after said bowl has been sealed, wherein said pressurizing chamber comprises a cylinder containing a piston, said piston comprising a rod disposed coaxial with, and extending outside of, said pressurizing chamber;

a helical spring disposed outside of, and concentric to, said rod, the length of said helical spring being limited at one end by the outer wall of said pressurizing cylinder and being limited at the other end by a first stop attached to the end of said rod, said first stop being adapted, when said piston is in its end-of-stroke position corresponding to the end of the evacuation of water from said pressurizing cylinder, to actuate the second contactor thereby initiating the end of said evacuation cycle of said toilet system, whereby said trap is closed and the projection of water from said at least one nozzle ceases.

* * * * *